US010591864B2

(12) United States Patent
Iketani

(10) Patent No.: US 10,591,864 B2
(45) Date of Patent: Mar. 17, 2020

(54) IMAGE FORMING APPARATUS INCLUDING A UNIT DETACHABLY MOUNTED ON AN APPARATUS BODY VIA A LOCKING MEMBER

(71) Applicant: KYOCERA Document Solutions Inc., Osaka (JP)

(72) Inventor: Takeshi Iketani, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/416,331

(22) Filed: May 20, 2019

(65) Prior Publication Data

US 2019/0361386 A1 Nov. 28, 2019

(30) Foreign Application Priority Data

May 22, 2018 (JP) ..... 2018-098227

(51) Int. Cl.
*G03G 15/00* (2006.01)
*G03G 15/20* (2006.01)
*G03G 21/16* (2006.01)

(52) U.S. Cl.
CPC ..... *G03G 21/1619* (2013.01); *G03G 21/1633* (2013.01)

(58) Field of Classification Search
CPC ..... G03G 15/2017; G03G 21/1619; G03G 21/1623; G03G 21/1633; G03G 21/1685
USPC ..... 399/110, 122
See application file for complete search history.

(56) References Cited

U.S. PATENT DOCUMENTS 9,158,270 B2 * 10/2015 Nanno ..... G03G 21/1685
9,310,724 B2 * 4/2016 Fukuda et al. ..... G03G 15/2017

FOREIGN PATENT DOCUMENTS

JP 2011-191400 9/2011

* cited by examiner

*Primary Examiner* — William J Royer
(74) *Attorney, Agent, or Firm* — Wenderoth, Lind & Ponack, L.L.P.

(57) ABSTRACT

An image forming apparatus includes a predetermined unit detachably received in an image forming apparatus body, a locking member that locks the predetermined unit, and an opening and closing cover that opens and closes an opening formed on a sidewall of the image forming apparatus body. The predetermined unit is configured not to be detachable from the image forming apparatus body through the opening unless the opening and closing cover is detached from the image forming apparatus body. The image forming apparatus includes a connection support member detachably engaged with a rotation center part of the opening and closing cover to serve as a shaft and connecting the opening and closing cover to the image forming apparatus body. The connection support member is detached from the opening and closing cover and is also used as a member for operating an unlocking mechanism.

4 Claims, 15 Drawing Sheets

IMAGE FORMING APPARATUS INCLUDING A UNIT DETACHABLY MOUNTED ON AN APPARATUS BODY VIA A LOCKING MEMBER

CROSS-REFERENCE TO RELATED APPLICATION

This application is based upon and claims the benefit of priority from Japanese Patent Application No. 2018-098227 filed on May 22, 2018, the entire contents of which are incorporated herein by reference.

BACKGROUND

The technology of the present disclosure relates to an image forming apparatus.

In general, an image forming apparatus such as a printer includes various units for forming an image on a sheet. Examples of the units include a fixing unit that heats and presses a toner image carried on a sheet to fix the toner image to the sheet, a drum unit having a photosensitive drum and the like for forming the toner image.

These units are detachably mounted on an apparatus body via a locking member, are detached from the apparatus body by unlocking the locking member as needed, and are mounted again on the apparatus body after repair or replacement of new units.

An example of the locking member for locking the fixing unit to the apparatus body will be described. The locking member has a claw part that is engaged with a hook engaging part provided in the apparatus body. The fixing unit has a pair of handles interlocking with the locking member. The fixing unit is mounted on the apparatus body such that the pair of handles are directed to an opening side of the apparatus body. The opening is closed by an opening and closing cover. When detaching the fixing unit, the aforementioned opening and closing cover is opened and the pair of handles are grasped by both hands and rotated inward. In this way, the locking member is rotated and the engagement between the claw part and the hook engaging part is released. In this way, the fixing unit can be taken out of the apparatus body.

SUMMARY

An image forming apparatus according to one aspect of the present disclosure includes a predetermined unit, a locking member, and an opening and closing cover. The predetermined unit is detachably received in an image forming apparatus body. The locking member locks the predetermined unit in a state in which the predetermined unit is mounted in the image forming apparatus body. The opening and closing cover opens and closes an opening formed on a sidewall of the image forming apparatus body.

Furthermore, the opening and closing cover is a rotary cover that opens and closes the opening by rotating about a shaft as a fulcrum. The predetermined unit is configured not to be detachable from the image forming apparatus body through the opening unless the opening and closing cover is detached from the image forming apparatus body.

Furthermore, the image forming apparatus further includes a connection support member and an unlocking mechanism. The connection support member is detachably engaged with a rotation center part of the opening and closing cover to serve as the shaft and connects the opening and closing cover to the image forming apparatus body. The unlocking mechanism is configured to be able to release locking of the predetermined unit by the locking member. The connection support member is also used as a lock releasing member for operating the unlocking mechanism.

DETAILED DESCRIPTION

Hereinafter, an example of an embodiment will be described in detail on the basis of the drawings. It is noted that the technology of the present disclosure is not limited to the following embodiment.

Embodiment

Figure 1:
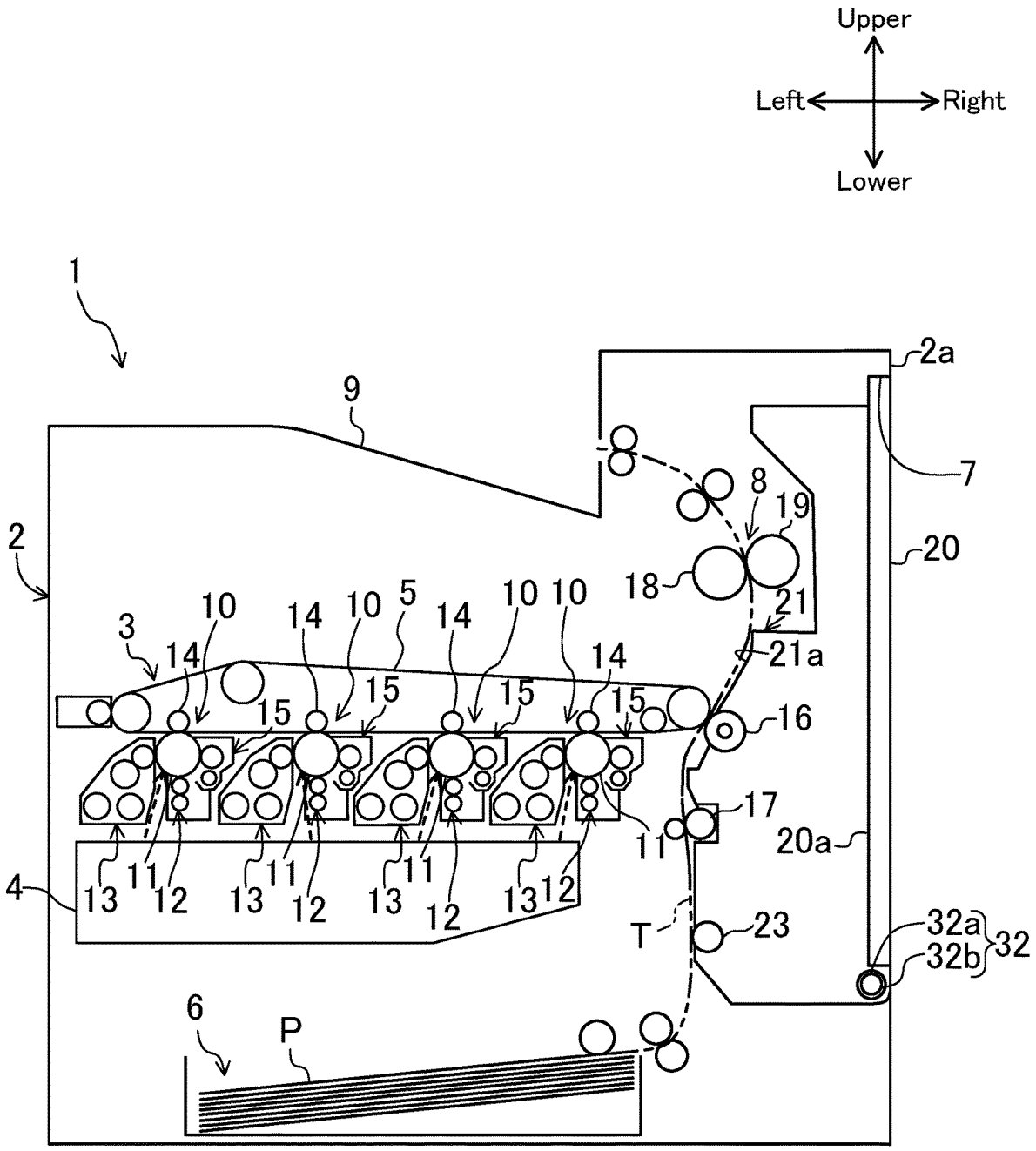
FIG. 1 is a schematic configuration view illustrating an image forming apparatus in an embodiment.

FIG. 1 is a schematic configuration view illustrating an example of an image forming apparatus 1 in an embodiment. In this example, the image forming apparatus 1 is a tandem type color printer. In the following description, a front side and a rear side indicate a front side and a rear side (a front side and a back side in a direction perpendicular to the paper surface of FIG. 1) of the image forming apparatus 1, and a left side and a right side indicate a left side and a right side when the image forming apparatus 1 is viewed from the front side.

The image forming apparatus 1 has an image forming apparatus body 2 having a rectangular box shape in appearance. The image forming apparatus body 2 receives an image forming unit 3 therein. The image forming unit 3 transfers an image to a sheet P and forms the image on the sheet P on the basis of image data transmitted from an external device such as a computer subjected to network connection and the like. Below the image forming unit 3, an exposure device 4 is disposed to emit laser beams, and above the image forming unit 3, a transfer belt 5 is disposed. Below the exposure device 4, a sheet feeding unit 6 is disposed to store the sheet P. Above the right side of the transfer belt 5, a fixing unit 8 (an example of a predetermined unit) is disposed to perform a fixing process on the image transferred to and formed on the sheet P. On the upper part of the image forming apparatus body 2, a sheet discharge unit 9 is formed to discharge the sheet P subjected to the fixing process in the fixing unit 8. The image forming apparatus 1 is provided therein with a sheet conveyance path T extending toward the sheet discharge unit 9 from the sheet feeding unit 6. A rectangular opening 7 is formed in a right side wall 2*a* adjacent to the sheet conveyance path T in the image forming apparatus 1. The opening 7 is closed by a rotary opening and closing cover 20.

The image forming unit 3 includes four image forming units 10 disposed in a row along the transfer belt 5. Each of the image forming units 10 has a photosensitive drum 11. Directly under each photosensitive drum 11, a charging device is disposed, and on the left side of each photosensitive drum 11, a developing device 13 is disposed. Directly above each photosensitive drum 11, a primary transfer roller 14 is disposed, and on the right side of each photosensitive drum 11, a cleaning unit 15 is disposed to clean the peripheral surface of the photosensitive drum 11.

The peripheral surface of each photosensitive drum 11 is uniformly charged by the charging device 12, and laser beams corresponding to each color based on the image data input from the aforementioned computer and the like are emitted to the charged peripheral surface of each photosensitive drum 11 from the exposure device 4. As a consequence, an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a primary transfer bias applied to the primary transfer roller 14.

A secondary transfer roller 16 is disposed on the right side of the transfer belt 5. The secondary transfer roller 16 is disposed in the state of abutting the transfer belt 5. The secondary transfer roller 16 interposes the sheet P conveyed from the sheet feeding unit 6 along the sheet conveyance path T between the secondary transfer roller 16 and the transfer belt 5. A secondary transfer bias is applied to the secondary transfer roller 16, so that the toner images on the transfer belt 5 are transferred to the sheet P by the applied secondary transfer bias. In the drawing, the reference numeral 17 denotes a resist roller that adjusts the timing of supplying the sheet P to the image forming unit 3, and the reference numeral 23 denotes a guide roller that guides the sheet P.

The fixing unit 8 includes a heating roller 18 and a pressure roller 19, wherein the sheet P is interposed by the heating roller 18 and the pressure roller 19 so as to be heated while being pressed. By so doing, the fixing unit 8 fixes the toner images, which have been transferred to the sheet P, to the sheet P. The sheet P subjected to the fixing process is discharged to the sheet discharge unit 9.

[Configuration of Opening and Closing Cover]

Figure 2:
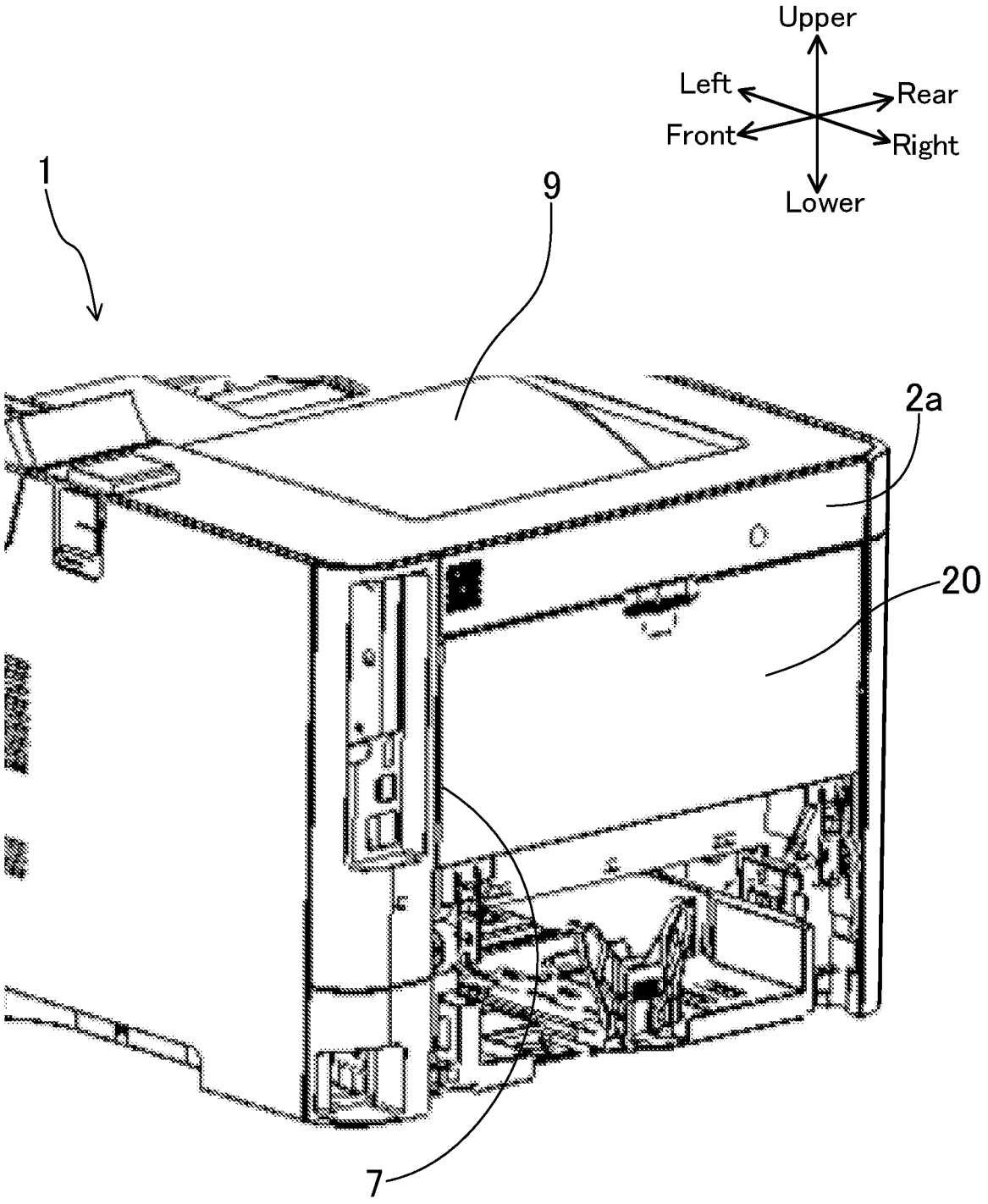
FIG. 2 is an external appearance perspective view illustrating the image forming apparatus in the embodiment.
Figure 3:
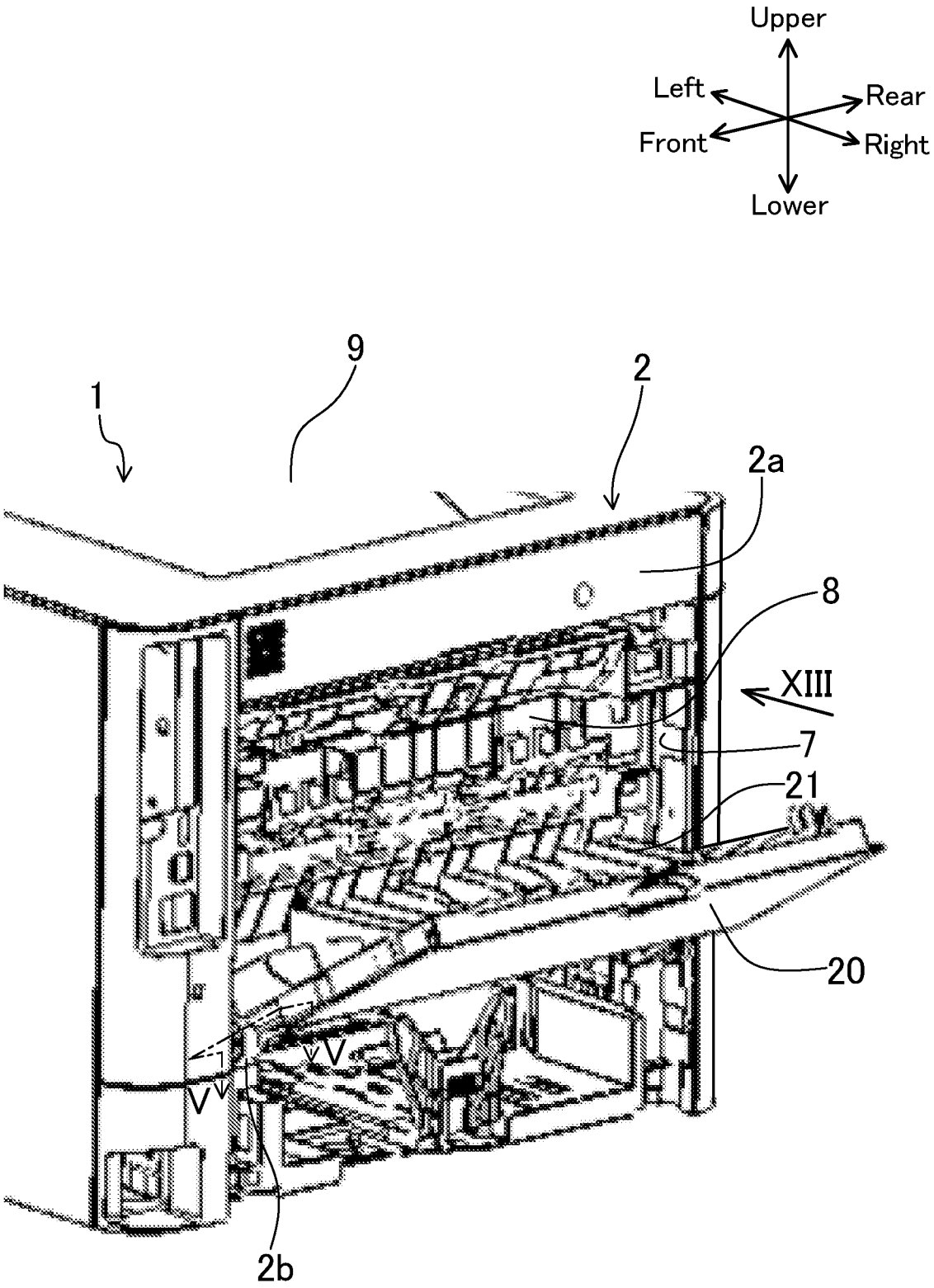
FIG. 3 is a view corresponding to FIG. 2, which illustrates a state in which an opening and closing cover of the image forming apparatus in the embodiment is opened.

Next, with reference to FIG. 1 to FIG. 3, the opening and closing cover 20 will be described. The opening and closing cover 20 is formed in an approximately rectangular plate shape in correspondence to the shape of the opening 7. A guide member 21 is attached to an inner wall surface 20*a* (an inner side surface of the image forming apparatus 1) of the opening and closing cover 20. The guide member 21 has a sheet guide surface 21*a* extending along the sheet conveyance path T. The sheet guide surface 21*a* is provided with the secondary transfer roller 16, the resist roller 17, and the guide roller 23.

The opening and closing cover 20 is rotatable about its lower end edge as a fulcrum between a fully closed position and an open position. In the fully closed position, the opening 7 is closed by the opening and closing cover 20 as illustrated in FIG. 2. The open position is a state in which the opening and closing cover 20 is tilted (rotated) by a predetermined angle from the fully closed position to the outside of the image forming apparatus body 2 as illustrated in FIG. 3.

The opening angle of the opening and closing cover 20 in the open position is limited by a stopper member (not illustrated). When the opening and closing cover 20 is in the open position, a user can access the inside of the image forming apparatus body 2 through the opening 7 to remove a jammed sheet or replace a predetermined component, but is not able to take the fixing unit 8 out of the image forming apparatus body 2.

That is, the maximum opening angle of the opening and closing cover 20 is set to the extent that the fixing unit 8 is not able to pass through between the opening and closing cover 20 and the image forming apparatus body 2. The fixing unit 8 is not taken out of the image forming apparatus body 2 through the opening 7 unless the opening and closing cover 20 is detached from the image forming apparatus body 2.

[Support Structure of Opening and Closing Cover]

Figure 4:
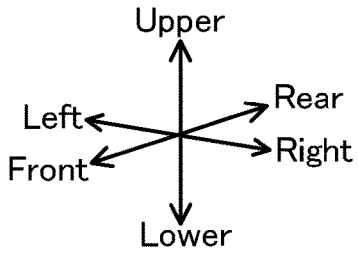
FIG. 4 is an enlarged perspective view illustrating a rotation center part of the opening and closing cover.
Figure 4:
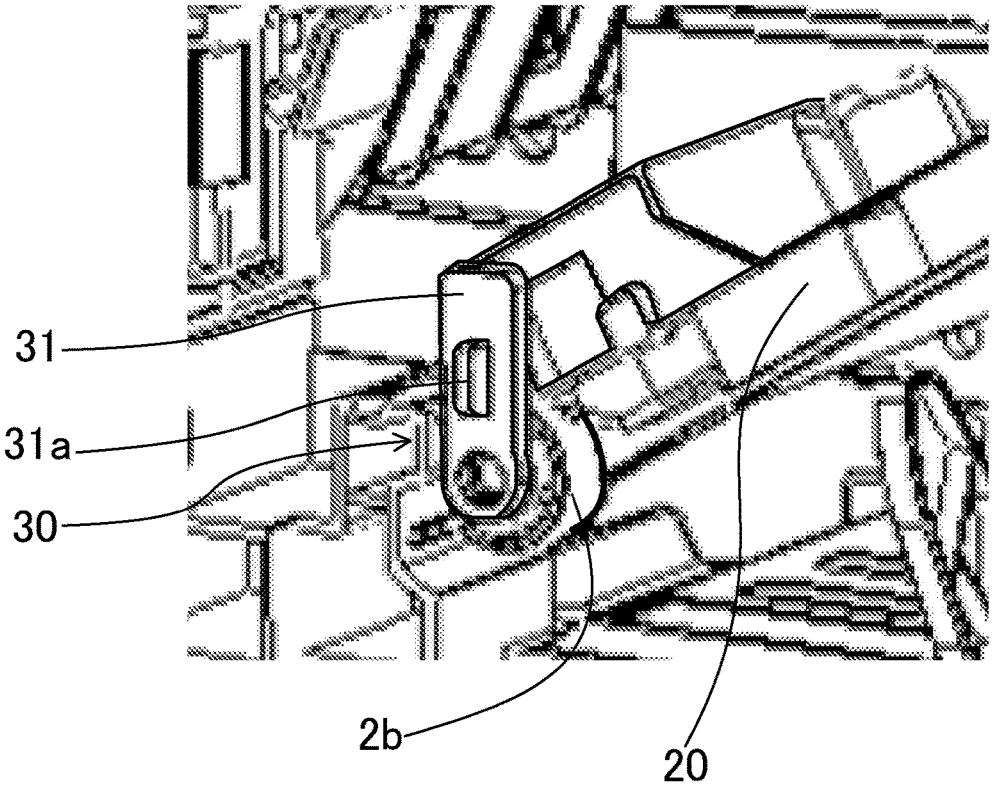
Figure 5:
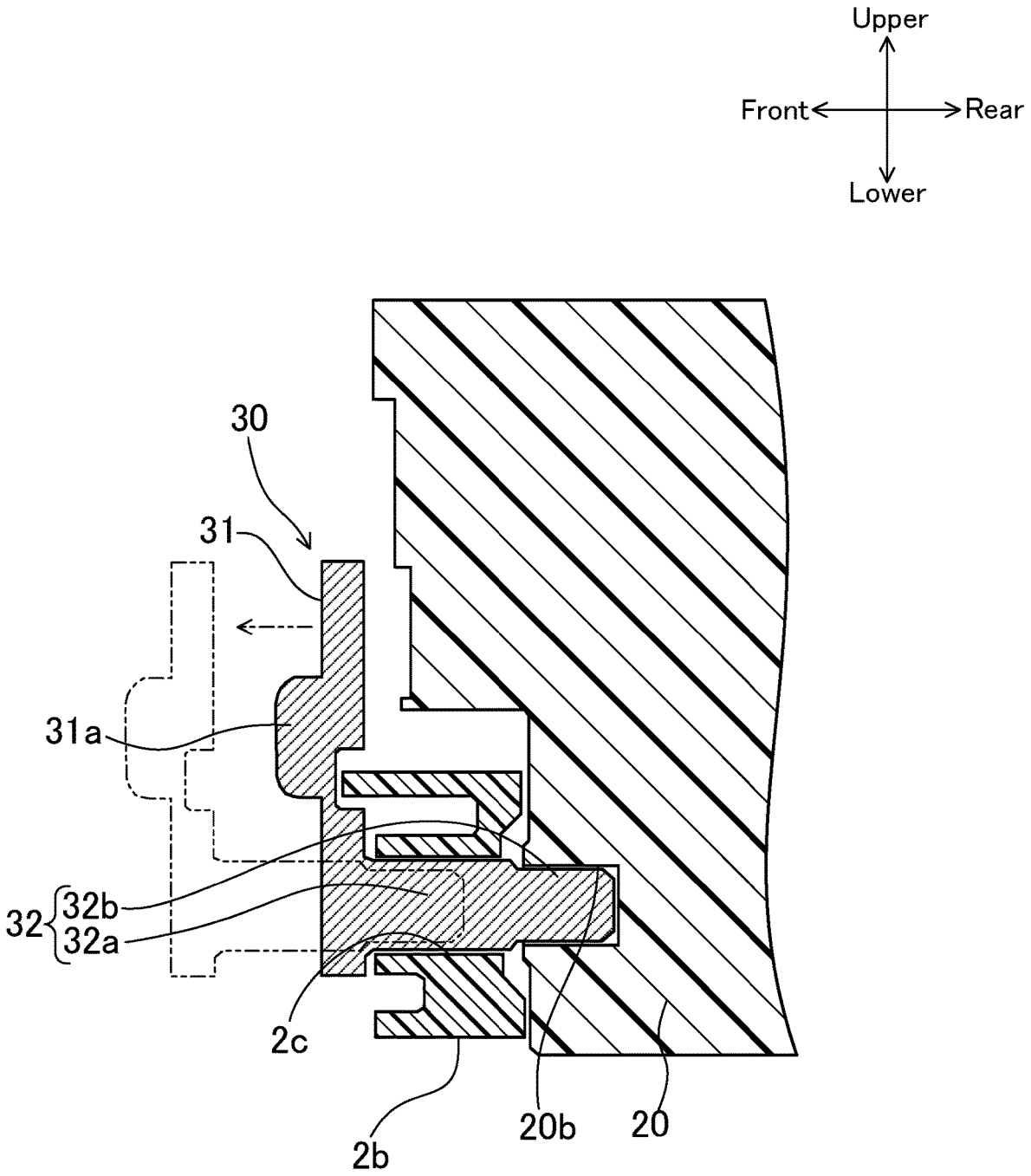
FIG. 5 is a sectional view taken along line V-V of FIG. 3.

Next, with reference to FIG. 4 and FIG. 5, the support structure of the opening and closing cover 20 with respect to the image forming apparatus body 2 will be described. A pair of cover support parts 2*b* are formed in the vicinity of the lower end of the opening 7 in the image forming apparatus body 2 to face each other in a front and rear direction with the lower end of the opening and closing cover 20 interposed therebetween. Since the support structure of the opening and closing cover 20 by the pair of cover support parts 2*b* is the same, FIG. 4 and FIG. 5 illustrate only the front cover support part 2*b*.

Each cover support part 2*b* is formed in a cylindrical shape having a support hole 2*c*. A support hole 20*b* is formed coaxially with the support hole 2*c* on both side surfaces of the lower end of the opening and closing cover 20 in the front and rear direction. A shaft 32 of a connection support member 30 is inserted into the support hole 2*c* and the support hole 20*b*. By so doing, the opening and closing cover 20 is rotatably supported to the shaft 32.

[Configuration of Connection Support Member]

Figure 6:
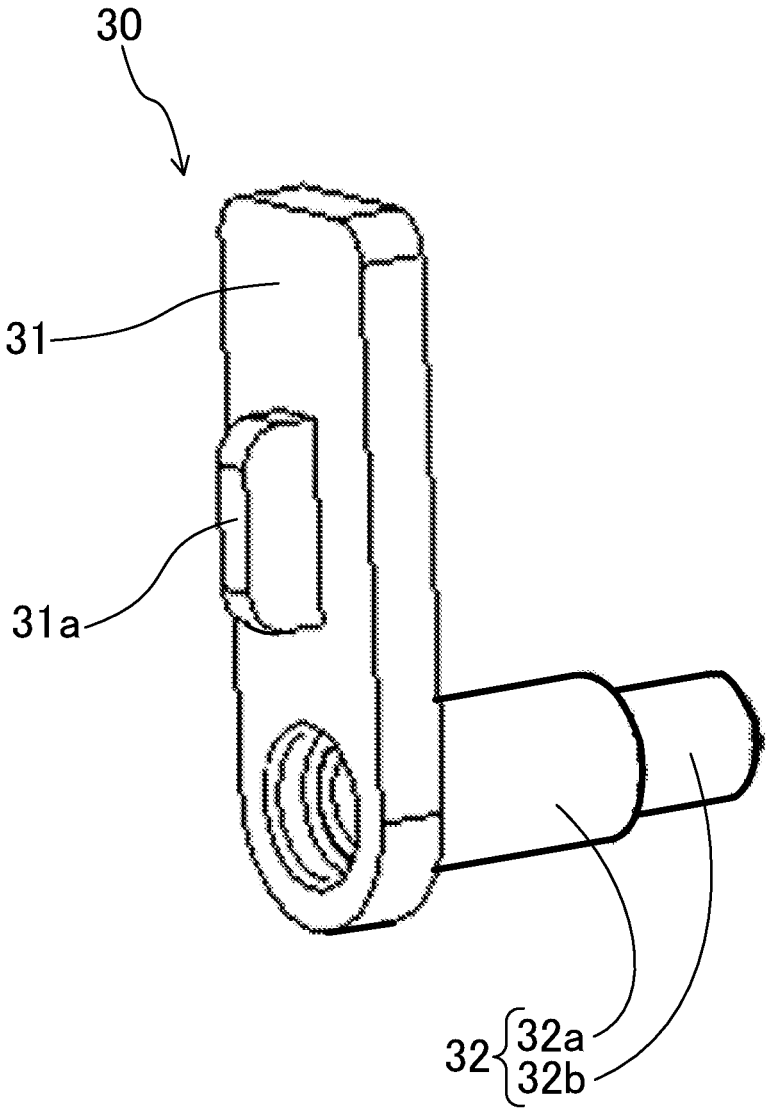
FIG. 6 is an external appearance perspective view illustrating a connection support member of the opening and closing cover.

As illustrated in FIG. 6, the connection support member 30 has a rectangular plate part 31 and the shaft 32 protruding from one side surface of the plate part 31. The shaft 32 is composed of a large diameter part 32*a* on its proximal end side and a small diameter part 32*b* on its distal end side. An outer peripheral surface of the large diameter part 32*a* is fitted to an inner peripheral surface of the support hole 2*c* of the cover support part 2*b*. An outer peripheral surface of the small diameter part 32*b* is fitted to an inner peripheral surface of the support hole 20*b* of the opening and closing cover 20. A plate-like knob 31*a* protrudes from a surface of the plate part 31 opposite to the shaft 32 side. In a state in which the opening and closing cover 20 is in the closed position, the plate-like knob 31*a* faces the inner wall surface of the image forming apparatus body 2 with a slight gap therebetween. By so doing, the connection support member 30 is prevented from being pulled out by the inner wall surface of the image forming apparatus body 2. On the other hand, when the opening and closing cover 20 is moved to the open position, the connection support member 30 is exposed to the outside of the image forming apparatus body 2. Consequently, a user can grasp the plate-like knob 31*a* to pull out the connection support member 30 from the both support holes 2*c* and 20*b* (see the two-dot chain line of FIG. 5). When the connection support member 30 is pulled out, there is no member for restricting the opening and closing cover 20, so that the opening and closing cover 20 can be detached from the image forming apparatus body 2.

[Configuration of Fixing Unit]

On the inner side of the opening and closing cover 20 in the image forming apparatus body 2, the fixing unit 8 is detachably mounted.

Figure 7:
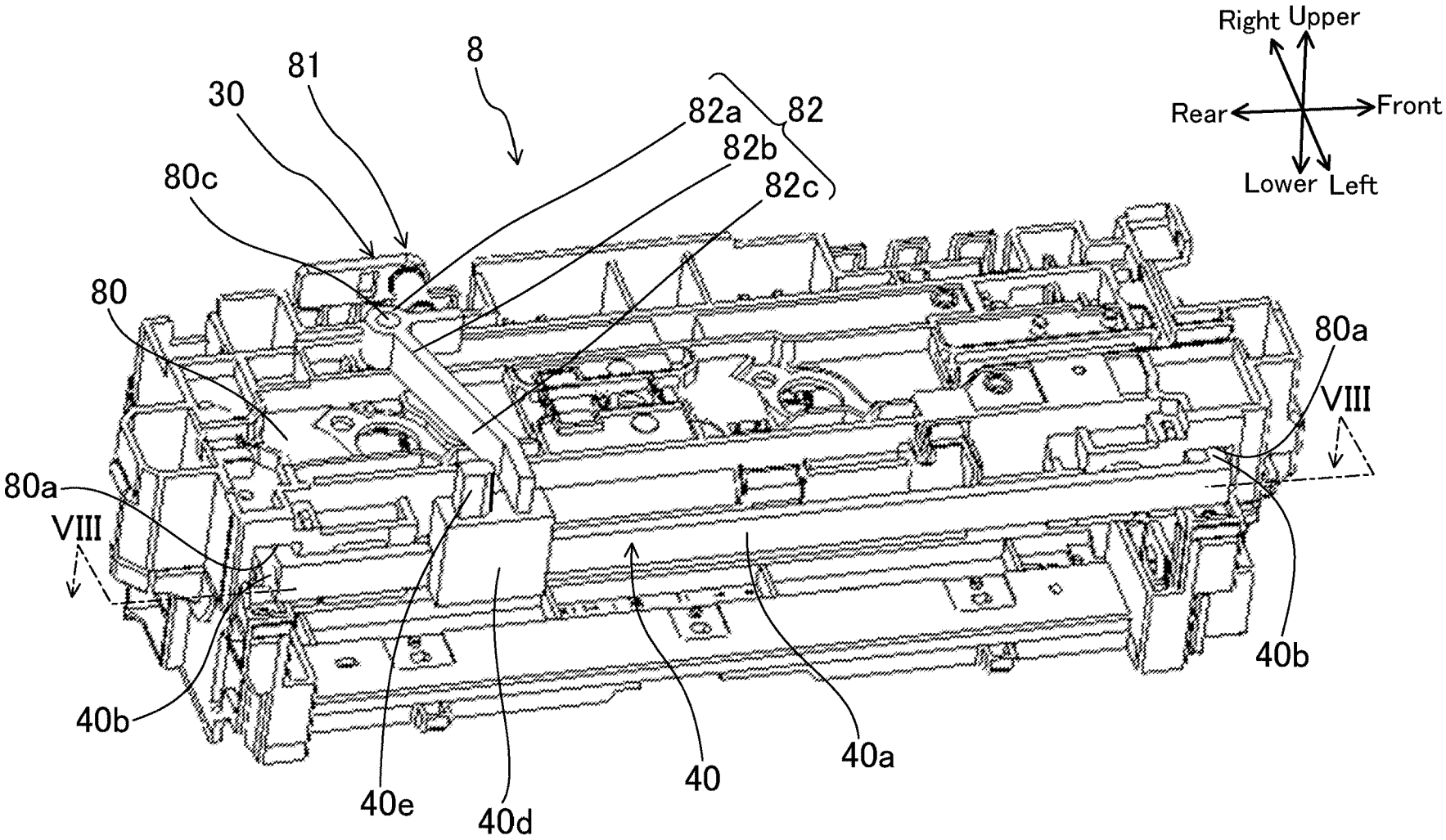
FIG. 7 is a perspective view when a fixing unit locked by a locking member provided in an image forming apparatus body is viewed from the inside of the apparatus.

As illustrated in FIG. 7, the fixing unit 8 has a casing 80 that receives the heating roller 18 and the pressure roller 19 therein. The casing 80 has a hollow box shape extending in an axial direction of the heating roller 18 and the pressure roller 19. In a state in which the casing 80 is mounted in the image forming apparatus body 2, the longitudinal direction of the casing 80 and the front and rear direction of the image forming apparatus body 2 coincide with each other. The casing is locked in the mounted state by a locking member 40 provided in the image forming apparatus body 2.

A pair of insertion holes 80*a*, through which the locking member 40 is inserted, are formed on sidewalls of the casing 80 opposite to the side of the opening and closing cover 20. The casing 80 is provided on the upper surface thereof with an unlocking mechanism 81 for releasing the locking of the casing 80 by the locking member 40. The unlocking mechanism 81 is driven by a dedicated lock releasing member. The connection support member 30 is available as the lock releasing member.

[Locking Mechanism of Fixing Unit]

Figure 8:
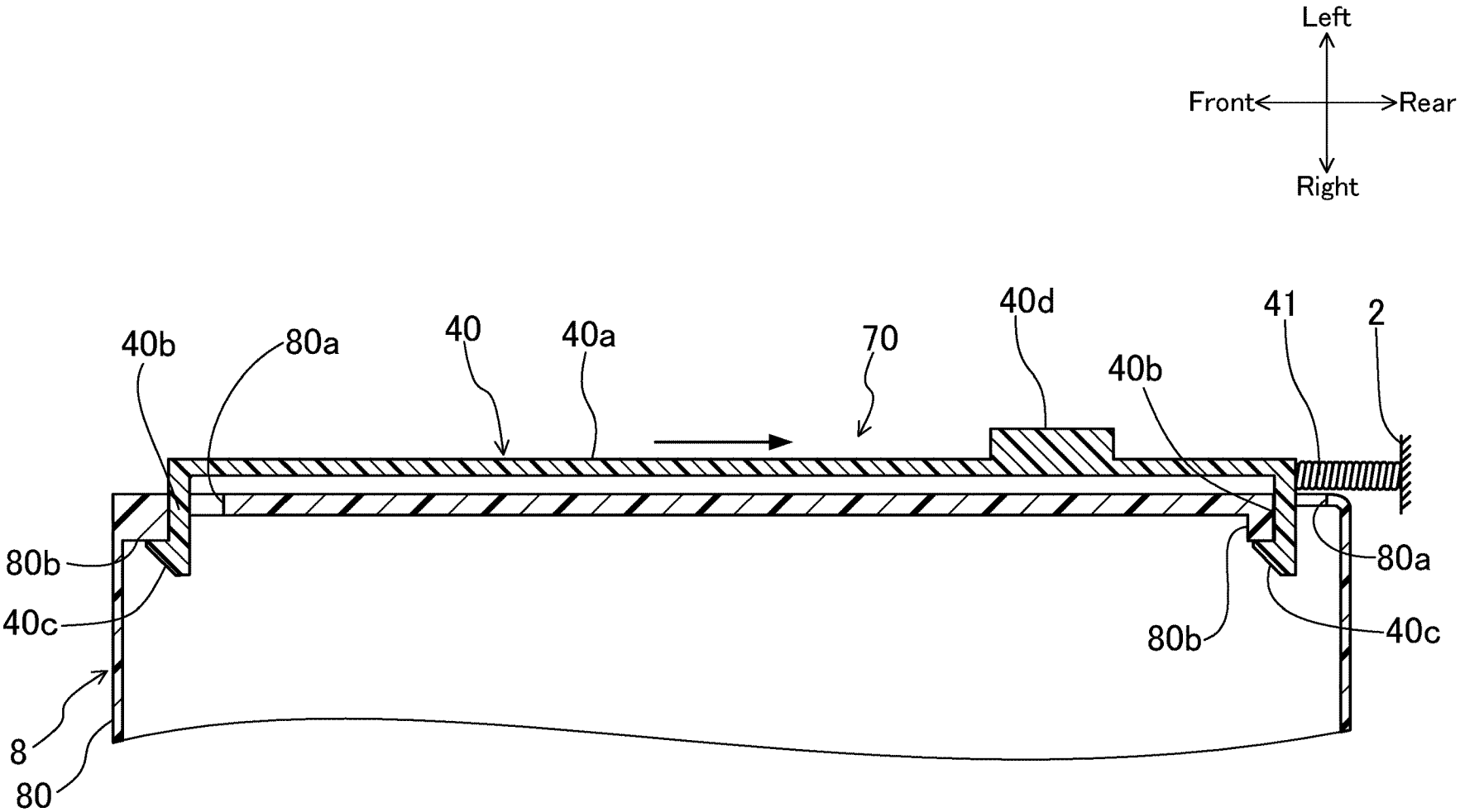
FIG. 8 is a view corresponding to the section taken along line VIII-VIII of FIG. 7, which illustrates a state in which the locking member is in a lock position where the fixing unit is locked.
Figure 9:
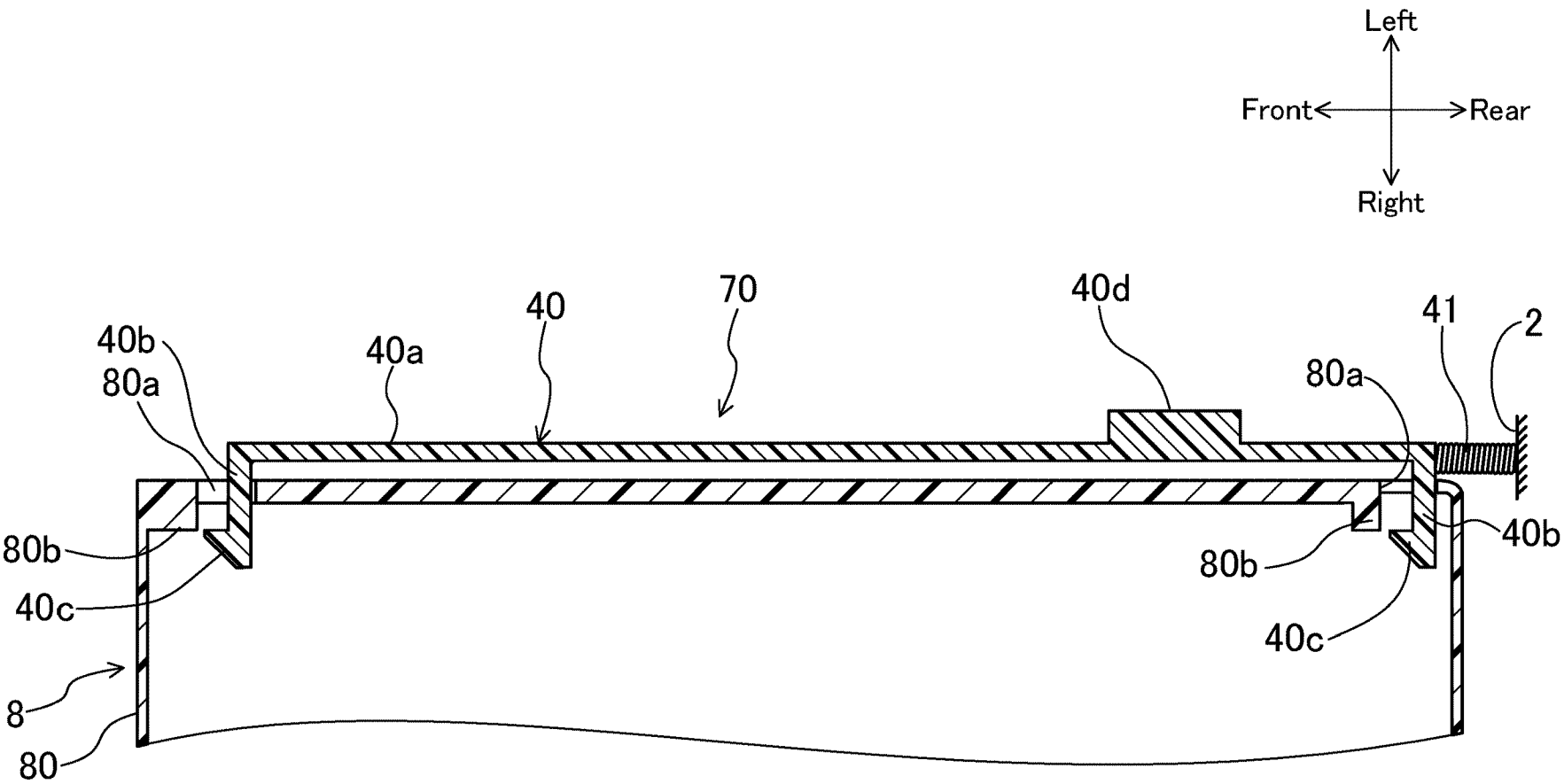
FIG. 9 is a view corresponding to FIG. 8, which illustrates a state in which the locking of the fixing unit by the locking member is released.

With reference to FIG. 7 to FIG. 9, a locking mechanism 70 for locking the fixing unit 8 to the mounted state will be described in detail. The locking mechanism 70 has the locking member 40 and a compression coil spring 41 (an example of an urging member and illustrated only in FIG. 8 and FIG. 9) that urges the locking member 40 to a lock side.

The locking member 40 is attached so as to be slidable in the front and rear direction with respect to the image forming apparatus body 2. Specifically, the locking member 40 has a slide plate part 40*a*, a pair of protruding pieces 40*b*, and a pair of claw parts 40*c*.

The slide plate part 40*a* has a vertical plate shape extending in the front and rear direction. The slide plate part 40*a* is guided so as to be movable in the front and rear direction by a guide member (not illustrated) provided in the image forming apparatus body 2. A rectangular parallelepiped block part 40*d* is integrally formed on a part near the rear side of the slide plate part 40*a*. A pressed part 40*e* (see FIG. 7) protrudes from an upper surface of the block part 40*d* to receive pressing force in a lock releasing direction by the unlocking mechanism 81.

The pair of protruding pieces 40*b* protrude from both ends of the slide plate part 40*a* in the front and rear direction to the fixing unit 8 side (right side). In a state in which the fixing unit 8 is mounted in the image forming apparatus body 2, each protruding piece 40*b* is inserted into the insertion holes 80*a* formed on the sidewall of the casing 80. The pair of claw parts 40*c* are formed at the distal ends of the protruding pieces 40*b*.

The compression coil spring 41 is disposed in a compressed state between a rear end of the locking member 40 and a rear wall of the image forming apparatus body 2. Furthermore, the compression coil spring 41 always urges the locking member 40 to the front side.

In the lock state illustrated in FIG. 8, the locking member 40 is urged to the front side by the compression coil spring 41, so that the pair of claw parts 40*c* are engaged with engaged block parts 80*b* formed on an inner wall surface of the casing 80 (see FIG. 8). When the locking member 40 is moved to the rear side against the urging force of the compression coil spring 41 from this state, the engagement between the pair of claw parts 40*c* and the engaged block parts 80*b* is released as illustrated in FIG. 9. By so doing, the locking of the fixing unit 8 by the locking member 40 is released, so that the fixing unit 8 enters an unlocked state.

[Unlocking Mechanism of Fixing Unit]

Figure 10:
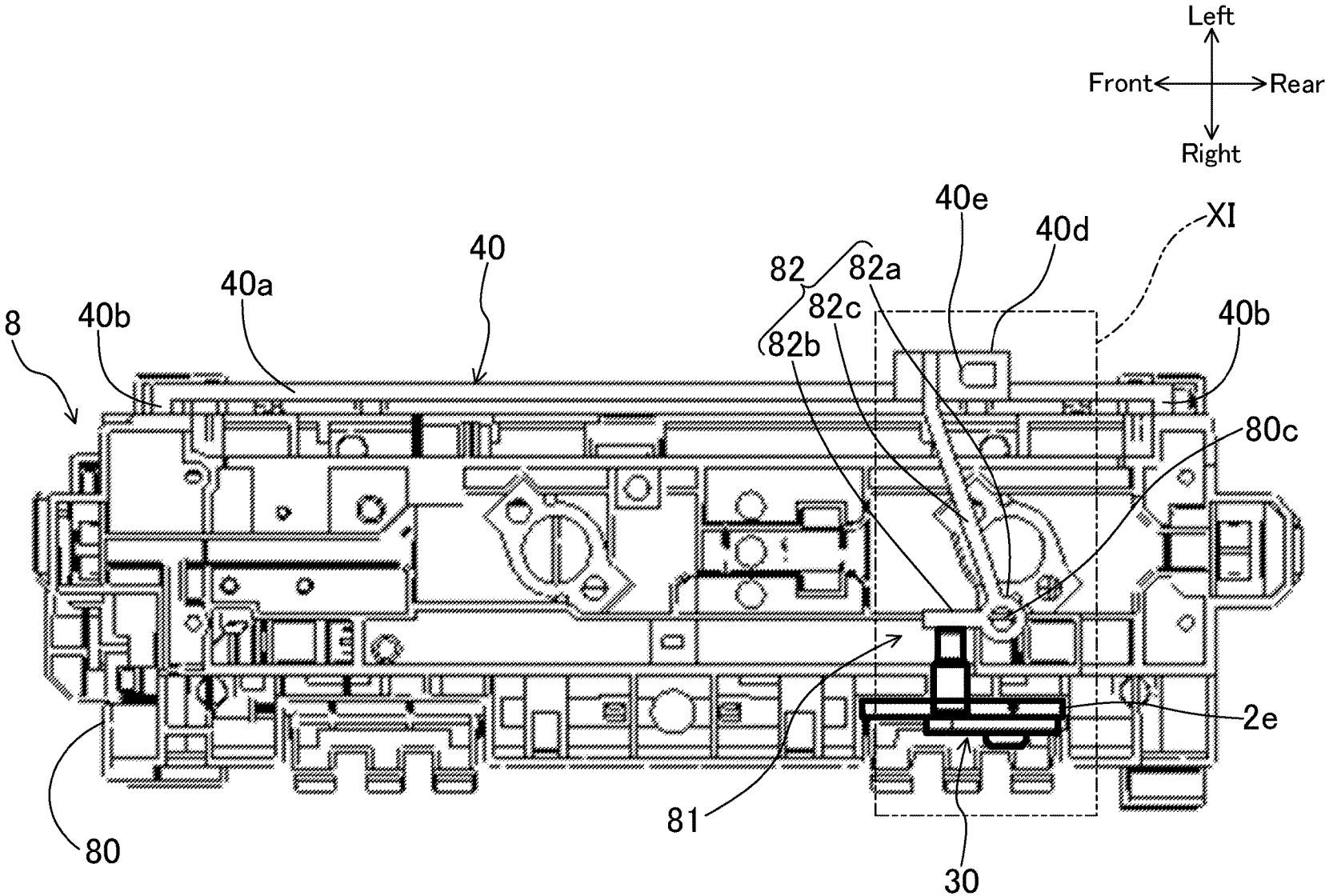
FIG. 10 is a plan view when the fixing unit is viewed from above.
Figure 11:
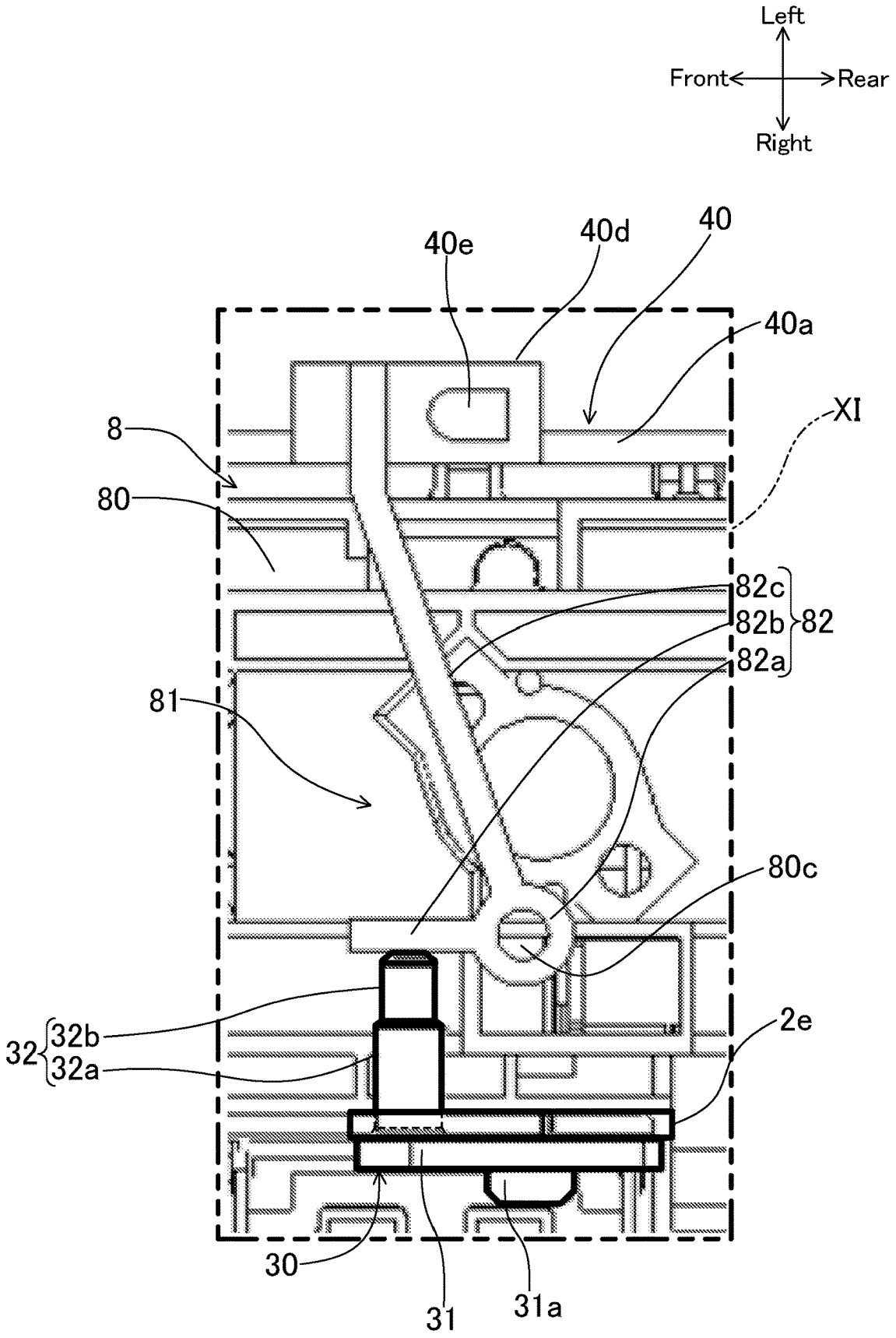
FIG. 11 is an enlarged view illustrating a part XI of FIG. 10.
Figure 12:
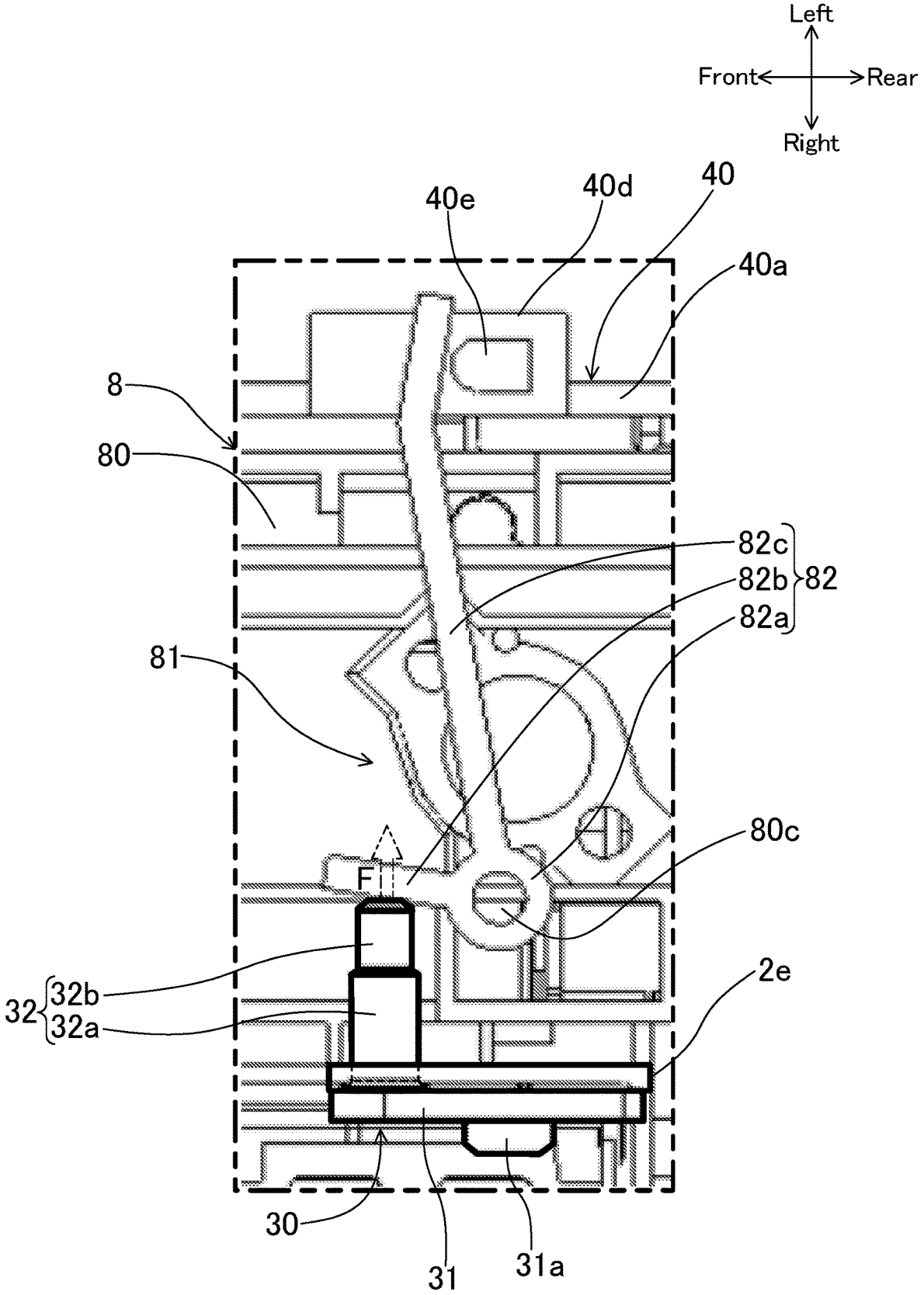
FIG. 12 is a view corresponding to FIG. 11, which illustrates a state in which the locking by the locking member is released.

With reference to FIG. 10 to FIG. 12, the unlocking mechanism 81 will be described. The unlocking mechanism 81 is a mechanism for releasing the locking of the fixing unit 8 by the locking member 40.

Specifically, the unlocking mechanism 81 has a columnar protruding pin part 80*c* protruding from the upper surface of the casing 80, and a swing member 82 swingably supported to the protruding pin part 80*c*.

The swing member 82 has a cylindrical part 82*a*, a first protruding piece 82*b*, and a second protruding piece 82*c*. The cylindrical part 82*a* is externally fitted to the protruding pin part 80*c* so as to be swingable. The first protruding piece 82*b* protrudes radially outward from an outer peripheral surface of the cylindrical part 82*a*. The first protruding piece 82*b* extends parallel to the front and rear direction. Similarly, the second protruding piece 82*c* also protrudes radially outward from the outer peripheral surface of the cylindrical part 82*a*. The second protruding piece 82*c* is disposed at an acute angle (for example, 60°) with respect to the first protruding piece 82*b* when viewed from above. A distal end of the second protruding piece 82*c* is slightly bent to have a plate shape perpendicular to the slide direction (the front and rear direction) of the locking member 40.

As illustrated in FIG. 11, in a state in which the fixing unit 8 is locked by the locking member 40, the distal end of the second protruding piece 82*c* is located on the front side of the pressed part 40*e* of the locking member 40 and does not abut the pressed part 40*e*. When predetermined operating force F is applied to the first protruding piece 82*b* of the swing member 82 from this state, the swing member 82 rotates in the clockwise direction of the drawing as illustrated in FIG. 12. As a consequence, the distal end of the second protruding piece 82*c* presses the pressed part 40*e* of the locking member 40 rearward, so that the locking member 40 slides rearward. In this way, the engagement between the pair of claw parts 40*c* of the locking member 40 and the engaged block parts 80*b* is released (see FIG. 9). The operating force F is applied by assembling/pushing the connection support member 30 to/into a plate 2*e* to be assembled (a part to be assembled).

[Configuration of Plate to be Assembled]

Figure 13:
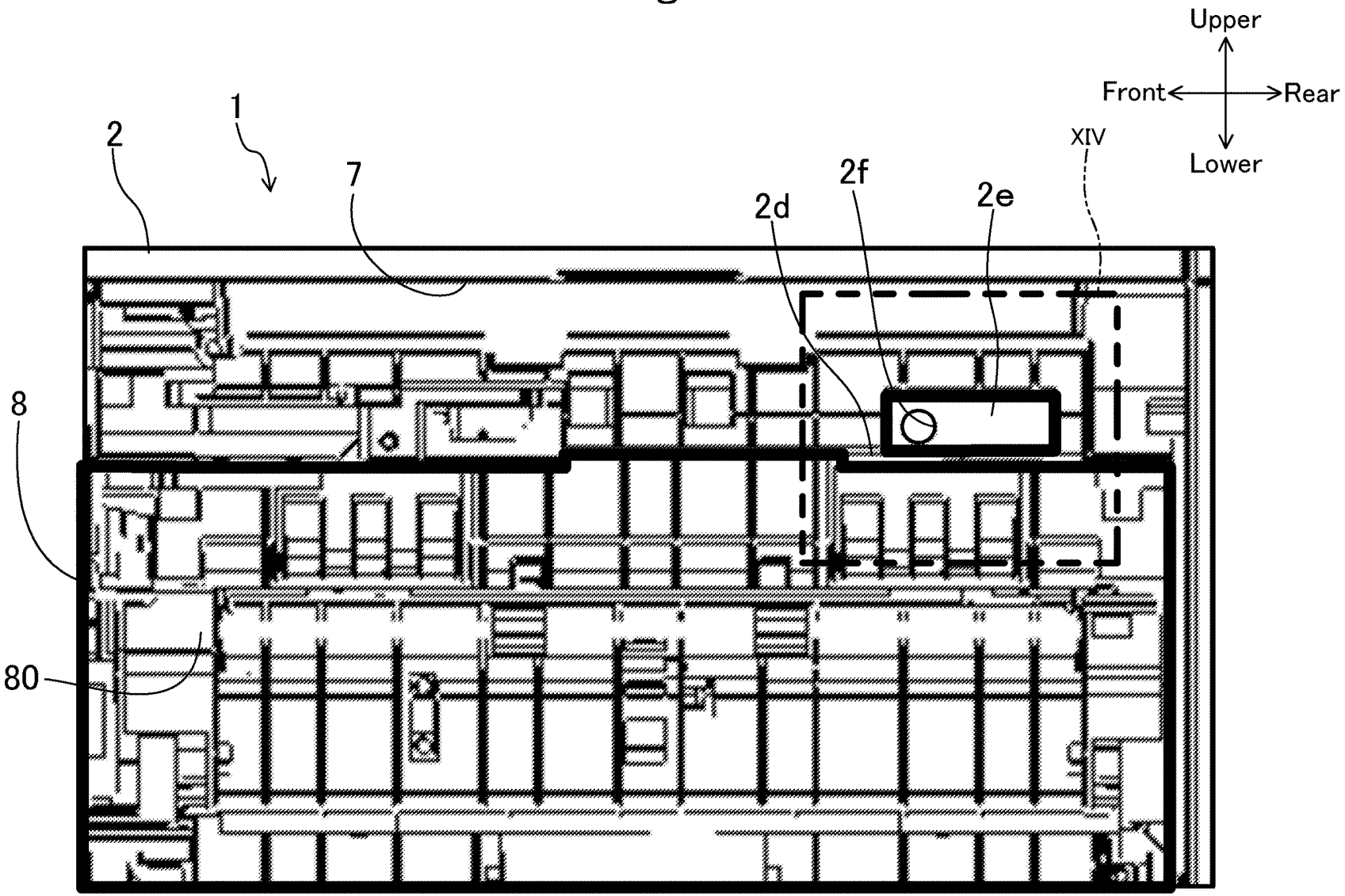
FIG. 13 is a view in the direction of the arrow XIII in FIG. 3.
Figure 14:
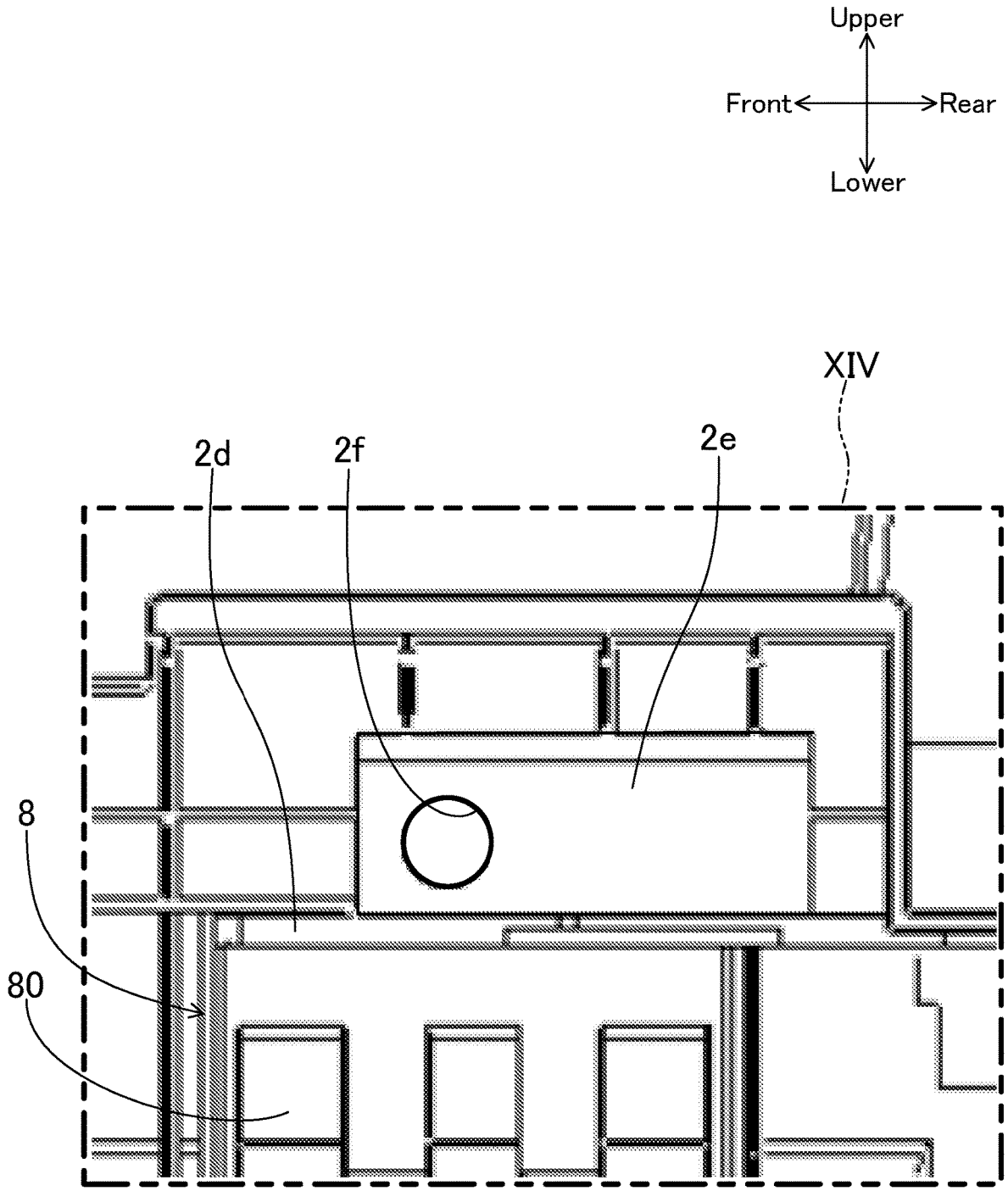
FIG. 14 is an enlarged view illustrating a part XIV of FIG. 13.
Figure 15:
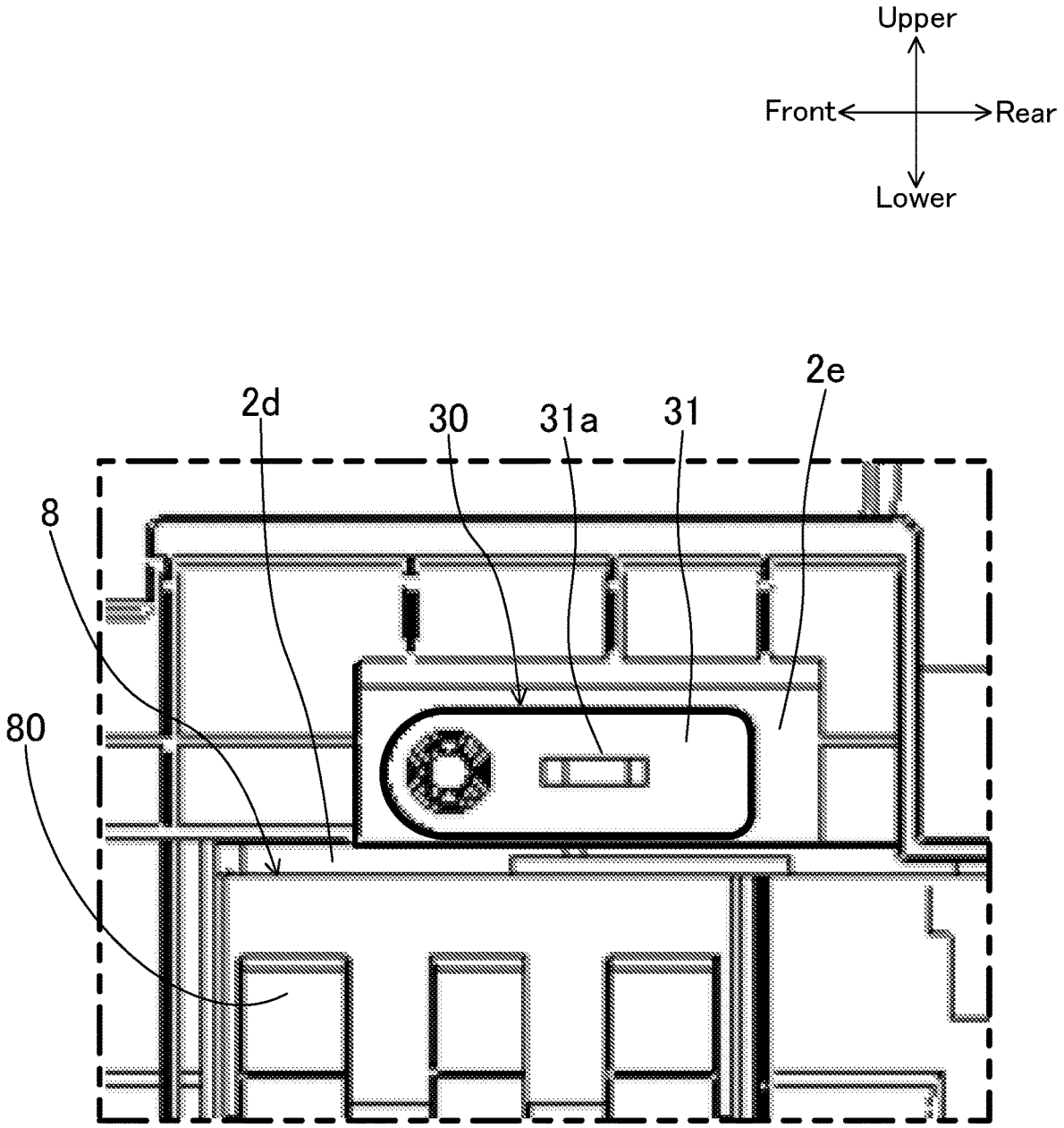
FIG. 15 is a view corresponding to FIG. 14, which illustrates a state in which the connection support member is assembled to a plate to be assembled.

As illustrated in FIG. 13 and FIG. 14, the plate 2*e* to be assembled is vertically installed on a horizontal plate part 2*d* fixed to a frame member of the image forming apparatus body 2. The horizontal plate part 2*d* is located in the vicinity of the upper side of a mounting space of the fixing unit 8. The plate 2*e* to be assembled is disposed so as to face the opening 7. The plate 2*e* to be assembled is exposed to the outside through the opening 7 by detaching the opening and closing cover 20. The plate 2*e* to be assembled has a rectangular plate shape that is long in the front and rear direction. The plate 2*e* to be assembled is formed at the front end thereof with a fitting hole 2*f* through which the shaft 32 of the connection support member 30 is inserted. When the connection support member 30 is assembled to the plate 2*e* to be assembled, the shaft 32 of the connection support member 30 is first inserted into the fitting hole 2*f* from the distal end thereof. When the outer peripheral surface of the large diameter part 32*a* of the shaft 32 comes to the inner peripheral surface of the fitting hole 2*f*, the distal end surface of the shaft 32 abuts the first protruding piece 82*b* of the swing member 82. At this stage, there is a slight gap between the plate part 31 and the plate 2*e* to be assembled. The connection support member 30 is pushed until the plate part 31 abuts the plate 2*e* to be assembled, so that the operating force F (see FIG. 12) is applied to the first protruding piece 82*b* of the swing member 82 from the distal end of the shaft 32.

[Detachment Work of Fixing Unit]

In the image forming apparatus 1 configured as described above, when the fixing unit 8 is detached from the image forming apparatus body 2, the connection support member 30 is first detached from the cover support parts 2*b* (see FIG. 5). By so doing, the opening and closing cover 20 is brought into a free state and is detached from the image forming apparatus body 2. In this way, the fixing unit 8 can be taken out of the image forming apparatus body 2 through the opening 7, but it is also necessary to release the locking of the fixing unit 8. In this regard, the detached connection support member 30 is assembled to and pushed into the plate 2*e* to be assembled in the aforementioned procedure. By so doing, the unlocking mechanism 81 is operated to release the locking of the fixing unit 8 by the locking member 40, and then the fixing unit 8 is detached from the image forming apparatus body 2.

[Operation and Effect]

As described above, in the present embodiment, the connection support member 30, which is a component to be necessarily detached when detaching the fixing unit 8, is used as a lock releasing component. In this way, it is possible to prevent the unlocking mechanism 81 from being erroneously operated when a user performs work other than the detachment work of the fixing unit 8.

Furthermore, in the present embodiment, the unlocking mechanism 81 is configured to release the locking of the fixing unit 8 by the locking member 40 by applying the predetermined operating force F via the connection support member 30 assembled to the plate 2*e* to be assembled.

According to this configuration, the locking of the fixing unit 8 is not released unless a user intentionally applies the operating force F to the unlocking mechanism 81 via the connection support member 30. Thus, it is possible to prevent the locking of the fixing unit 8 from being unintentionally released.

Furthermore, in the present embodiment, the plate 2*e* to be assembled has the fitting hole 2*f* (a fitting part) fitted with the large diameter part 32*a* (a specific shape part) of the shaft 32 of the connection support member 30. Furthermore, the connection support member 30 is assembled to the plate 2*e* to be assembled by fitting the large diameter part 32*a* into the fitting hole 2*f*.

According to this configuration, it is possible to avoid an interchangeable component from being assembled to the plate 2*e* to be assembled as much as possible. Thus, when performing work other than the detachment work of the fixing unit 8, it is possible to reduce the possibility of an operation of the unlocking mechanism 81.

Furthermore, in the present embodiment, the unlocking mechanism 81 has the swing member 82 swingably supported to the protruding pin part 80*c*, and the swing member 82 has the cylindrical part 82*a* externally fitted to the protruding pin part 80*c* and the first and second protruding pieces 82*b* and 82*c* protruding radially outward from the cylindrical part 82*a* and spaced apart from each other in the circumferential direction. Furthermore, the unlocking mechanism 81 is configured such that the predetermined operating force F is input to the first protruding piece 82*b* via the connection support member 30, so that the second protruding piece 82*c* rotates around the protruding pin part 80*c* together with the cylindrical part 82*a* and the locking member 40 is driven to the unlock position (the position of FIG. 9) against the urging force of the compression coil spring 41.

According to this configuration, the unlocking mechanism can be compactly disposed to be fitted within the upper surface of the casing 80 of the fixing unit 8.

Other Embodiments

In the aforementioned embodiment, the fixing unit 8 has been described as an example of the predetermined unit; however, the technology of the present disclosure is not limited thereto. The predetermined unit, for example, may be the image forming unit 10, the developing device 13 and the like.

Furthermore, the aforementioned embodiment has described an example in which the image forming apparatus 1 is a printer; however, the technology of the present disclosure is not limited thereto. That is, the image forming apparatus 1 may be a copy machine, a facsimile, a multifunctional peripheral (MFP) and the like.

What is claimed is:

1. An image forming apparatus comprising:

a predetermined unit detachably received in an image forming apparatus body;

a locking member that locks the predetermined unit in a state in which the predetermined unit is mounted in the image forming apparatus body; and an opening and closing cover that opens and closes an opening formed on a sidewall of the image forming apparatus body, wherein the opening and closing cover is a rotary cover that opens and closes the opening by rotating about a shaft as a fulcrum, the predetermined unit is configured not to be detachable from the image forming apparatus body through the opening unless the opening and closing cover is detached from the image forming apparatus body, and the image forming apparatus further comprises:

a connection support member detachably engaged with a rotation center part of the opening and closing cover to serve as the shaft and connecting the opening and closing cover to the image forming apparatus body; and an unlocking mechanism that is able to release locking of the predetermined unit by the locking member, wherein the connection support member is configured to be usable as a lock releasing member for operating the unlocking mechanism.

2. The image forming apparatus of claim 1, wherein a part to be assembled is provided at a position of the image forming apparatus body facing the opening to allow assembly of the connection support member detached from the opening and closing cover, and the unlocking mechanism is configured to release the locking of the predetermined unit by the locking member when a predetermined operating force is applied via the connection support member assembled to the part to be assembled.

3. The image forming apparatus of claim 2, wherein the connection support member has a specific shape part, the part to be assembled has a fitting part that is fitted to the specific shape part, and the connection support member is assembled to the part to be assembled by fitting the specific shape part to the fitting part.

4. The image forming apparatus of claim 2, wherein the locking member is movable between a lock position where the predetermined unit is locked and an unlock position where the locking is released, the image forming apparatus further comprises:

an urging member that urges the locking member to the lock position, wherein the unlocking mechanism has a protruding pin part protruding from a side surface of the predetermined unit and a swing member swingably supported to the protruding pin part, and the swing member has a cylindrical part externally fitted to the protruding pin part, and first and second protruding pieces protruding radially outward from the cylindrical part and spaced apart from each other in a circumferential direction, and is configured such that the predetermined operating force is input to the first protruding piece via the connection support member, so that the second protruding piece rotates around the protruding pin part together with the cylindrical part and the locking member is driven to the unlock position against urging force of the urging member.

* * * * *